US005127770A

United States Patent [19]

Ditcher et al.

[11] Patent Number: 5,127,770

[45] Date of Patent: Jul. 7, 1992

[54] RETAINING WALL ASSEMBLY UTILIZING FACE PANELS INTERLOCKED WITH TIE-BACK/ANCHORS

[75] Inventors: Jack Ditcher, Langhorne; Gary K. Munkelt, Doylestown, both of Pa.

[73] Assignee: Atlantic Precast Concrete Inc., Tullytown, Pa.

[21] Appl. No.: 669,521

[22] Filed: Mar. 14, 1991

Related U.S. Application Data

[63] Continuation-in-part of Ser. No. 594,602, Oct. 9, 1990, abandoned.

[51] Int. Cl.[5] ..... E02D 29/02

[52] U.S. Cl. ..... 405/262; 405/286

[58] Field of Search ..... 405/262, 272, 273, 284, 405/285, 286

[56] References Cited

U.S. PATENT DOCUMENTS

| | | | |
|---|---|---|---|
| 3,464,211 | 9/1969 | Andresen | 405/262 |
| 4,116,010 | 9/1978 | Vidal | 405/262 |
| 4,470,728 | 9/1984 | Broadbent | 405/284 |
| 4,514,113 | 4/1985 | Neumann | 405/286 |
| 4,661,023 | 4/1987 | Hilfiker | 405/262 |
| 4,874,272 | 10/1989 | Egan | 405/284 |
| 4,896,999 | 1/1990 | Ruckstuhl | 405/286 |
| 4,914,887 | 4/1990 | Meheen | 405/286 X |

*Primary Examiner*—David H. Corbin

*Attorney, Agent, or Firm*—Louis Weinstein

[57] ABSTRACT

A retaining wall assembly having a plurality of face plates which interlock with tie-backs. In one preferred embodiment, the face blocks have a substantially cross-shaped front face and recesses along top, bottom, left and right-hand sides which interlock with tie-back flanges. Each tie-back, through its interlocking flanges, interlocks with four adjacent face blocks. The tie-backs have back feet or anchors providing features of stability and anti-torsion. The tie-backs may utilize elongated rods which are joined interlocking key blocks as well as one or more anchors arranged at spaced intervals along the rods. At least the interengaging portions of the tie-backs and face plates are cast of highly durable casting material such as concrete, which is non-corrosive. The face plates have flat front and rear faces or, in another preferred embodiment, have flat front faces and integral rearwardly extending projections respectively provided with the top, bottom, left and right recesses which cooperate with the interengaging flanges. In another alternative embodiment, each of the face plates have a rectangular-shaped face and are provided with T-shaped grooves along their upper and lower sides for receiving and being interlocked with the interlocking flanges of at least four tie-backs. Each face panel typically interlocks with four adjacent face panels by way of the intermediate tie-back interlocking flanges.

33 Claims, 10 Drawing Sheets

14
14a
12n
12
12b
12g
12l
12i
12k
12l'
12i'
12k'
12m
12j
12d
12d-1
12q
12s
12h
12t
12a
12e
12p
12c
12c-1
12r
12f
12i
12k
12h
12l
12g
12p
12l
12i
12r

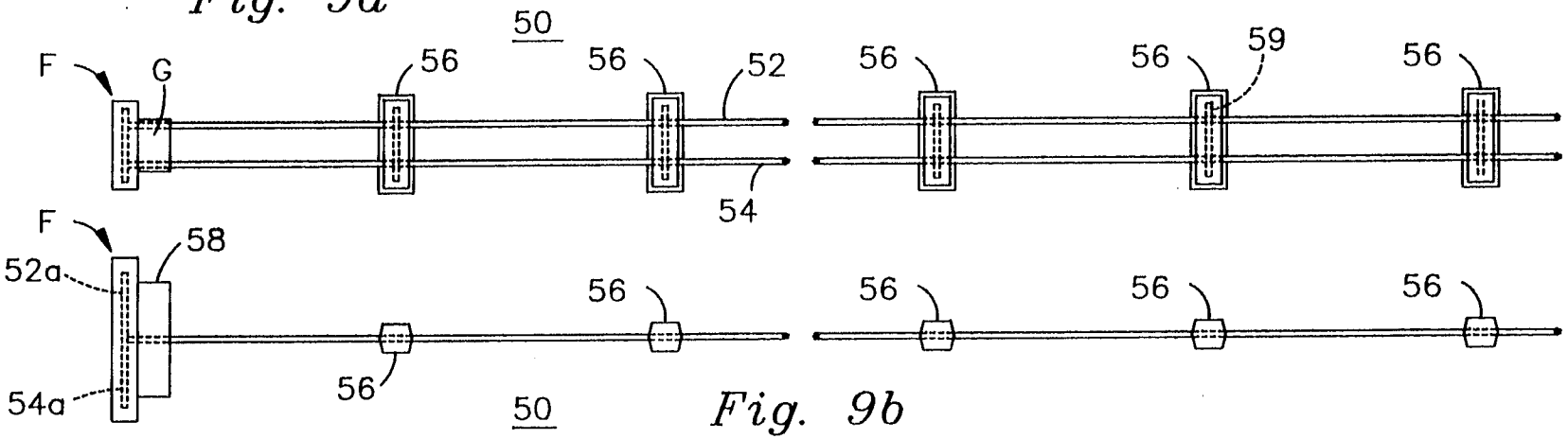
Fig. 9a
Fig. 9b
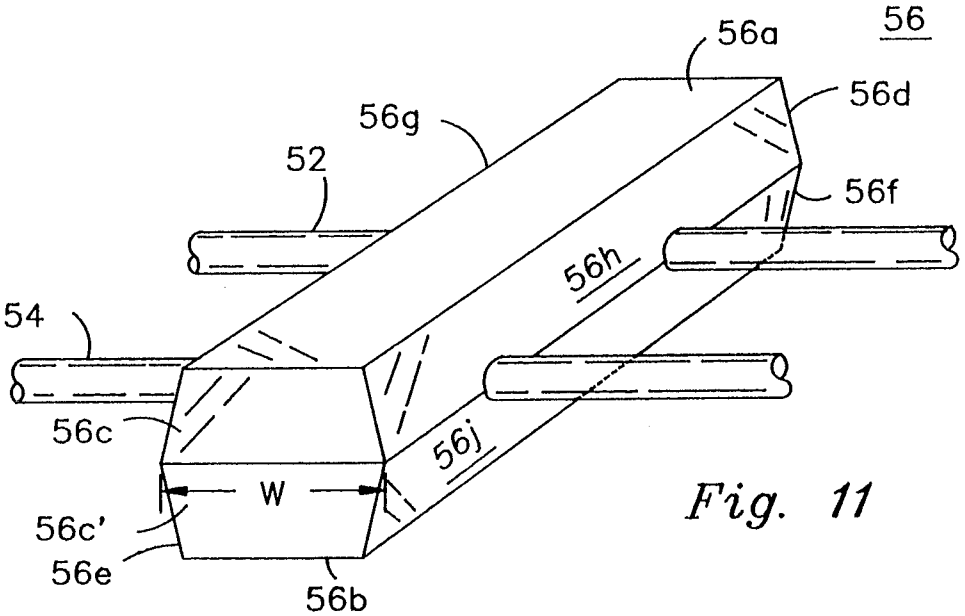
Fig. 11
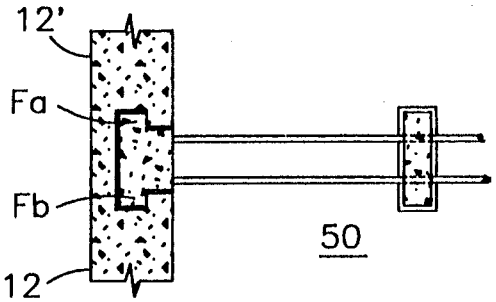
Fig. 10

RETAINING WALL ASSEMBLY UTILIZING FACE PANELS INTERLOCKED WITH TIE-BACK/ANCHORS

REFERENCE TO CORRESPONDING APPLICATION

This application is a continuation-in-part of U.S. application Ser. No. 594,602, filed Oct. 9, 1990, now abandoned.

FIELD OF THE INVENTION

The present invention relates to retaining wall assemblies, and more particularly, to a novel retaining wall assembly of interlocking components incorporating a common, durable casting material in which all of the components interlock without the need for separate fastening components, yielding a rugged, highly stable and durable retaining wall.

BACKGROUND OF THE INVENTION

Retaining walls are typically provided adjacent to highways, bridges, overpasses and the like and are designed to support highway fills or cuts especially in those applications where there is insufficient room adjacent such highways, bridges, overpasses and the like for providing an unsupported and natural slope.

Conventional retainer wall assemblies are typically comprised of substantially T-shaped or L-shaped members which include a face block and an integral elongated bar extending away from the face plate. Such integral members may be cast as a unitary structure from a suitable casting material such as is disclosed in U.S. Pat. No. 4,684,294, issued Aug. 4, 1987 or alternatively, may be cast of a casting material and further provided with a metallic reinforcing bar such as is disclosed in U.S. Pat. No. 4,067,166, issued Jan. 10, 1978. The above-mentioned structures are extremely heavy and significantly complicate the fabrication, handling and assembly of such large and bulky components. In addition, the elements have limited interlocking capabilities which degrade the strength, stability and ruggedness of the completed retaining wall assembly. Other systems reduce the weight of the overall structure by utilizing metallic bars which are mechanically fastened between face plates and anchor members, typically being anchored to the face plates and wrapped about the anchor members as disclosed in U.S. Pat. No. 4,514,113, issued Apr. 30, 1985. These structures have the disadvantage of experiencing significant corrosion in use requiring replacement at a much more frequent rate than retainer wall assemblies formed of rugged, non-corrosive materials, such as concrete. U.S. Pat. No. 4,514,113 describes a retaining wall system employing metallic rods joining the face plates and anchor members. The face plates of the retaining wall assembly disclosed in U.S. Pat. No. 4,514,113 also fails to disclose interlocking means for reinforcing, stabilizing and strengthening the face plates when fully assembled.

BRIEF DESCRIPTION OF THE INVENTION

The present invention overcomes the disadvantages of present day retainer wall assemblies by providing a novel retainer wall assembly which is characterized by comprising separate face plates and tie-backs incorporating a suitable casting material and which interlock with one another in a unique and simple fashion to provide a rugged, stable and durable retainer wall assembly.

In one preferred embodiment, each face plate has a substantially cross-shaped outline and is provided with recesses along its top, bottom, left and right sides, which recesses cooperate with interlocking flanges provided at the forward end of each tie-back, the interlocking flanges causing each tie-back to interengage and lock in place four adjacent face plates. The face plates are interengaged by the tie-back/anchors in a unique fashion to further enhance the structural strength and alignment of the face of the retaining wall. Each tie-back extends rearwardly a distance which is a function of the height of the retaining wall and the free end of each tie-back is provided with stabilizing, anchoring feet extending in opposite directions from the tie-back to add further stability to the retaining wall assembly by resisting horizontal forces of the tie-backs and hence the face plates. Each member of the retaining wall assembly is simply aligned and lowered into place upon associated members and is automatically interlocked into the assembled position during the lowering operation thus simplifying assembly operations and totally eliminating the need for separate fastening members. Each member is cast of a suitable non-corrosive casting material which eliminates the need for metallic coupling bars, or other coupling elements employed in existing retaining wall systems, as a result of the unique interlocking arrangement thereby preventing the need for early repair and replacement of the retaining wall assembly due to corrosion.

The retaining wall assembly requires only two types of face plates, namely a face plate having a flat bottom edge for use as the first course of the retaining wall assembly; and a second type of face plate of the cross-shaped outline. The tie-backs, although identical in design regardless of which course they are employed in, preferably vary in length as a function of the height of the retaining wall assembly. Various lengths of tie-back/anchors may be employed for constructing a retaining wall. The longest are approximately 80% of wall height.

Each of the face plates of the preferred embodiment is provided with a substantially flat forward and rearward surface. As an alternative embodiment, however, the forward surfaces of the face plates may be made flat and the face plates may be provided with integral projections which extend rearwardly and are each provided with a recess for receiving and engaging the locking flanges of a cooperating tie-back. This alternative embodiment reduces the weight of the face plate.

In still another preferred embodiment of the present invention, the cross-shaped face plates may be substituted by face plates having a rectangular shape and provided with a pair of substantially T-shaped recesses along the top and bottom sides thereof for receiving and locking with the interengaging flanges of four tie-backs in such a manner that each face plate is interlocked with four adjacent face plates by way of the tie-backs. This latter embodiment requires only one type of face plate, thus reducing the number of components required to construct a retaining wall assembly.

Yet another preferred embodiment of the present invention utilizes face plate elements and interlocking tie-backs employing metallic rebars provided with a cast key block with flanges for interlocking with the face plates and a plurality of cast anchors arranged at spaced intervals along the rebar members. The interlocking members include concrete key blocks and stabilizing anchors while the metallic members, which are preferably rebars, provide tie-backs of reduced weight and increased ability to withstand loads, especially impact causing loads such as, for example, vehicular traffic. The rebars are galvanized or otherwise treated to withstand corrosion. The key blocks and anchors are reinforced by short cross-bars wire tied to the rebars to prevent degrading of the corrosion resistant layers.

The novel method for constructing a retaining wall assembly comprises the steps of laying down a levelling pad which defines the base of the retaining wall assembly. The first course of face plates is positioned upon the levelling pad, the number of face plates employed for the first course being a function with the length of the retaining wall. Thereafter, the interengaging flanges of the tie-backs are lowered into the cooperating recesses of the side plates, locking each side plate to the side plates on opposite sides thereof. The region behind each course of face plates is filled with earth which is compacted and will support the tie-backs to be employed for interlocking the next course of face plates. The tie-backs of the lower courses are preferably of greater length than the tie-backs employed in the upper courses with the length being a function of wall height. The tie-backs engage and interlock a minimum of three face plates between the first and second courses and a minimum of four face plates in each of the remaining courses of face plates, providing a simple and yet rugged, interlocking arrangement. The tie-back/anchors have integral front feet extending both laterally and vertically which interengage and interlock the face panels. The tie-back/anchors have integral rear feet extending laterally which anchor into the compacted backfill soil mass to create friction and resist pullout. The number and length of tie-back/anchors are so designed to reinforce and internally stabilize the soil and thereby use the tie-back/anchors and soil as a structural entity to restrain horizontal forces and prevent the wall from sliding or overturning. The use of separate tie-backs and face plates significantly simplify fabrication, transportation and assembly.

Retaining wall assemblies employing those elements of the alternative embodiments are constructed in a like fashion and yield similar, advantageous resulting assemblies.

OBJECTS OF THE INVENTION

It is, therefore, one object of the present invention to provide a novel retaining wall assembly comprised of independent interlocking face plates and tie-back/anchors.

Still another object of the present invention is to provide a novel retaining wall assembly formed of independent interlocking tie-backs and face plates which are formed of similar casting material.

Still another object of the present invention is to provide a novel retaining wall assembly comprised of independent interlocking tie-backs and face plates which are simply and readily cast from a suitable casting material.

Still another object of the present invention is to provide a novel retaining wall assembly comprised of independent interlocking tie-backs and face plates arranged in such a manner that each face plate is interlocked with a minimum of two adjacent face panels.

Still another object of the present invention is to provide a retaining wall assembly employing novel interlocking face plates and tie-backs comprised of rebars provided with a key block and anchors cast in place on the rebars.

BRIEF DESCRIPTION OF THE FIGURES

The above, as well as other objects of the present invention will become apparent when reading the accompanying description and drawings, in which:

FIGS. 9*a* and 9*b* show top and side views respectively of still another preferred embodiment for a tie-back assembly which may be utilized with the face plates shown in FIGS. 1, 5*a* and 6*a*, for example;

FIG. 10 shows a sectional view of two face plate portions showing the manner in which the face plates are interlocked with a tie-back of the type shown in FIGS. 9*a* and 9*b;*

FIG. 11 shows a perspective view of a typical cast anchor member employed in the tie-back shown in FIGS. 9*a* and 9*b;*

DETAILED DESCRIPTION OF THE INVENTION AND PREFERRED EMBODIMENTS THEREOF

Considering FIGS. 1*a* through 4, there is shown therein a face plate 12 designed in accordance with the principles of the present invention and having substantially flat front and rear faces 12*a*, 12*b*. The face plate 12 has a generally cross-shaped outline defining left and upwardly and downwardly directed projections 12*e* and 12*f*.

The upwardly and downwardly directed projections 12*e* and 12*f* are each provided with elongated recesses 12*g* and 12*h* respectively.

The left and right-hand extending projections 12*c* and 12*d* are each respectively provided with recesses 12*i* and 12*j*.

The face plate 12 is preferably fabricated of a suitable casting material such as concrete. The molding operation is simple and straightforward as a result of the simplified design of the face plate and may be cast in a mold in a single casting operation.

Each of the recesses 12*i* and 12*j* is defined by projecting portions 12*k*, 12*l* and 12*m*, 12*n*. The projections 12*l* and 12*n* are of reduced length as compared with projections 12*k* and 12*m* to facilitate receipt of a tie-back, as will be more fully described.

The tie-backs 14 employed with the face plates 12 are shown in FIGS. 2*a* through 2*d*, the tie-back being comprised of an elongated, substantially straight main body portion 14*a* having an integral interengaging flange assembly 14*b* at its forward or left-hand end and having an integral stabilizing flange portion 14*c* at its rearward or right-hand end. The forward, interengaging flange 14*b* has: a flange portion Fa which extends to the left of central portion 14*a*; an upper flange portion Fc which extends above central portion 14*a*; a flange portion Fb which extends to the right of central portion 14*a*; and a flange portion Fd which extends below central portion 14*a*. Considering FIG. 2*d*, the stabilizing flange portion 14*c* has a portion or foot F1 extending to the left of central portion 14*a* and a flange portion or foot F2 extending to the right of central portion 14*a*. The height of flange 14*c* is equal to the height of central portion 14*a*.

Figures 1A, 1B, 1C:
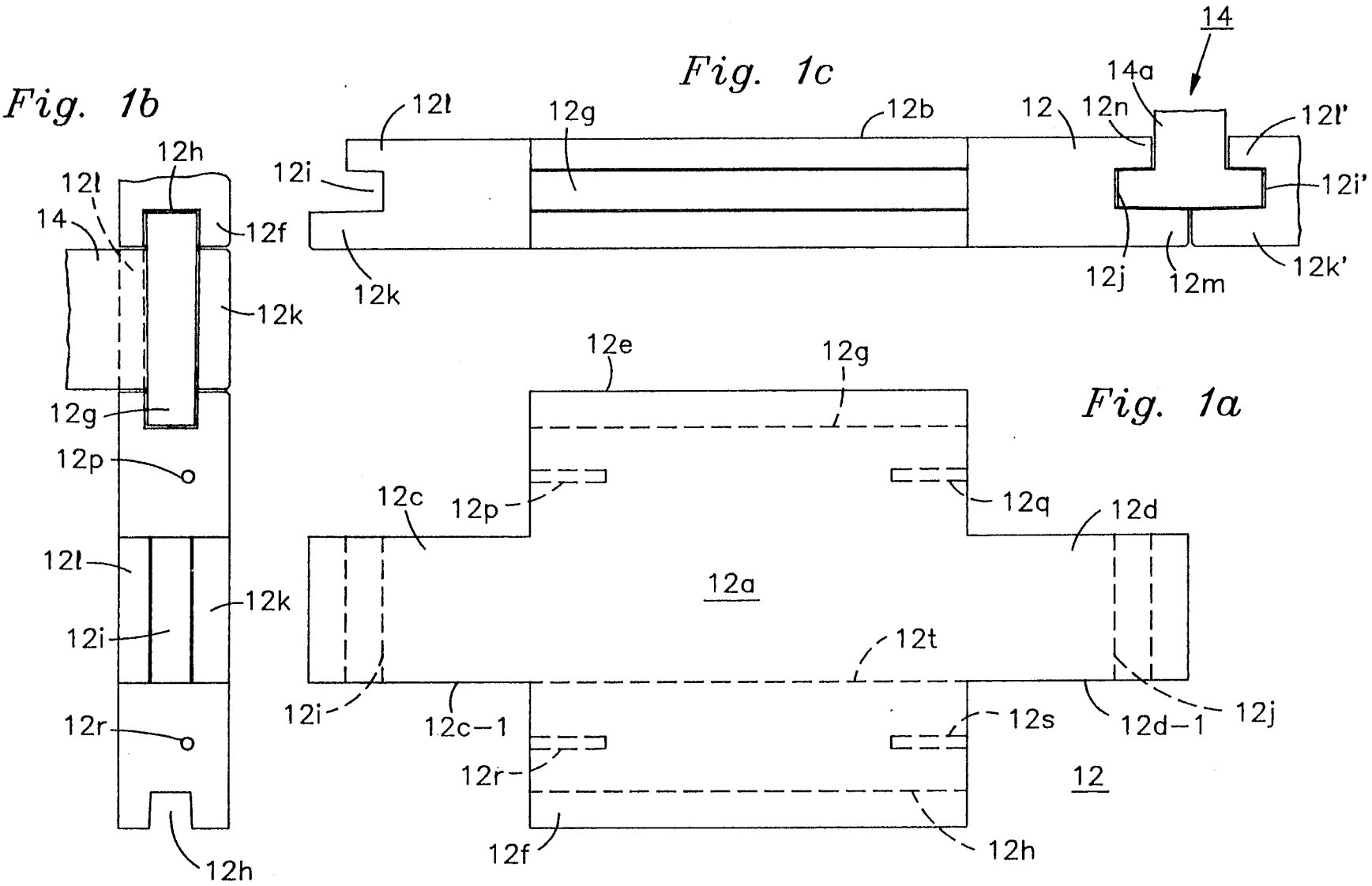
FIGS. 1*a*, 1*b* and 1*c* show front, left elevational and top views respectively of a face plate designed in accordance with the principles of the present invention, FIG. 1*c* further showing the manner in which two adjacent face plates arranged in the same course are interlocked by means of a common tie-back and FIG. 1*b* further showing the manner in which a face plate of a lower course is interlocked with a face plate of an upper course by means of a common tie-back.
Figure 4:
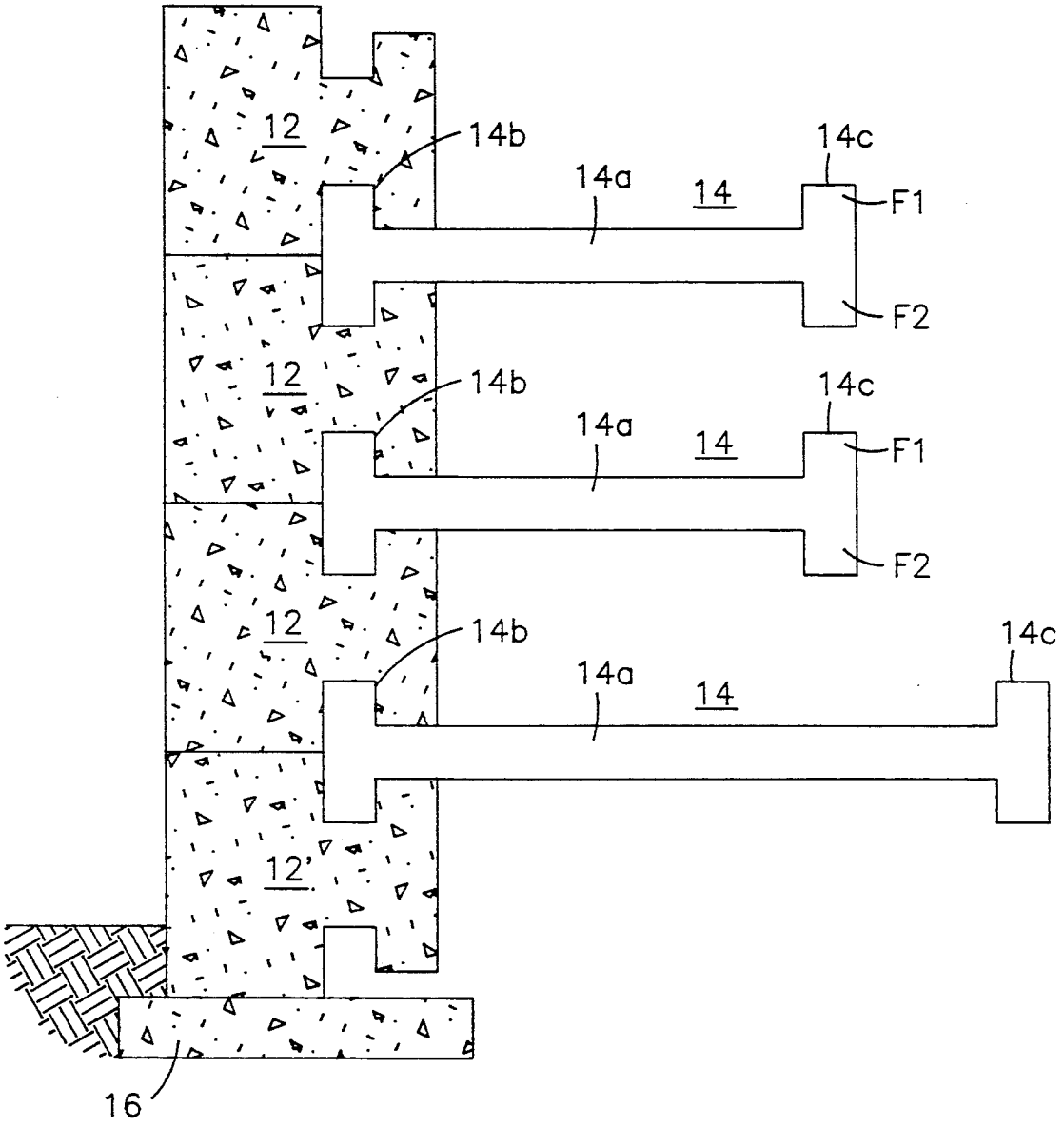
FIG. 4 shows an elevational view of a partially constructed retaining wall assembly.

The retaining wall assembly 10 shown in FIG. 4 utilizes the face plates shown in FIGS. 1*a*–1*c* and the tie-backs shown in FIGS. 2*a*–2*d* and further utilizes a face plate substantially similar to the face plate 12 shown in FIG. 1*a* with the exception that the lower projection 12*f* is removed so that the resulting face plate has a lower edge defined by the bottom sides 12*c*–*l* and 12*d*–*l* of projections 12*d* and dotted line 12*p*.

Figure 3:
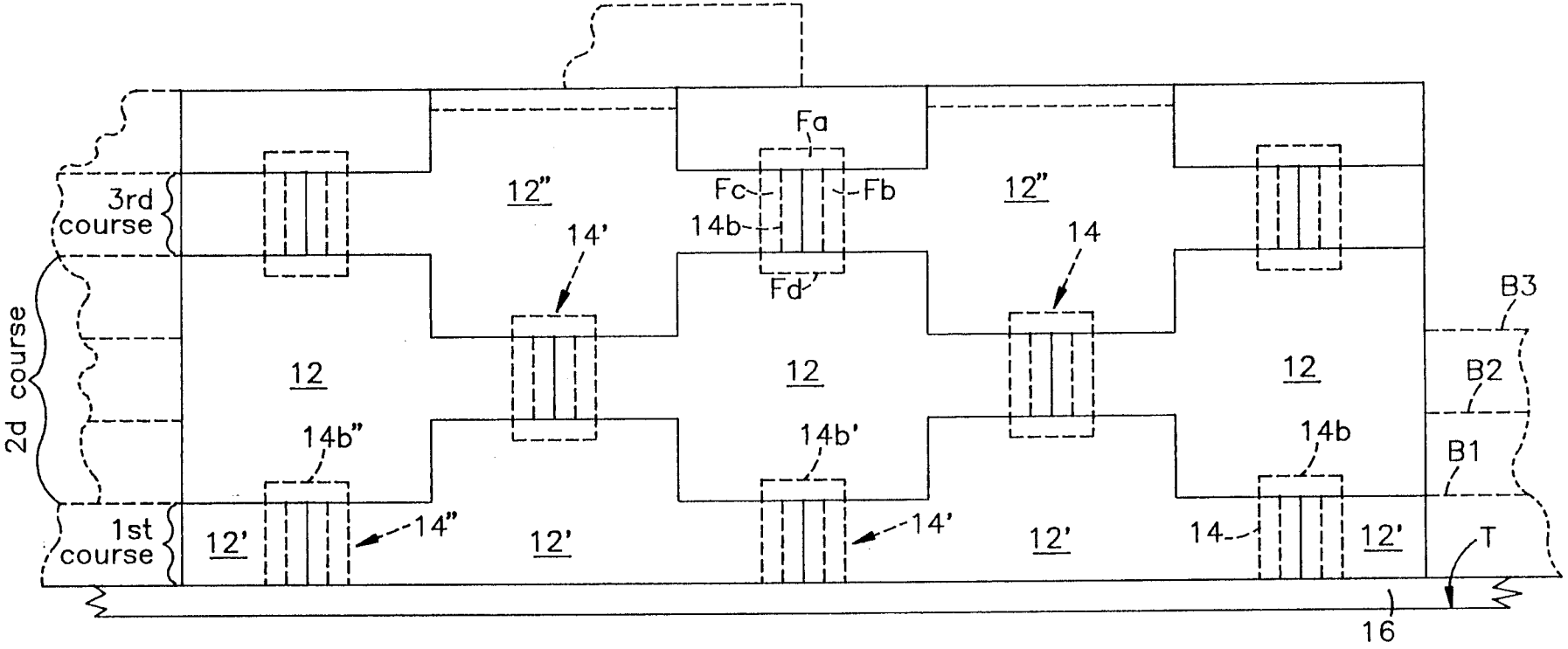
FIG. 3 shows an elevational view of a portion of a retaining wall assembly employing the face plates and tie-backs shown in FIGS. 1*a*–1*c* and 2*a*–2*d;*

The retaining wall assembly 10 is erected in the following manner:

Considering FIGS. 3 and 4, a shallow trench T is formed in the earth and a levelling pad 16 is placed in the shallow trench and is made level by the utilization of conventional techniques.

A first course of face plates 12' are arranged in side-by-side fashion in the manner shown in FIG. 3, the face plates 12' being of the type described in connection with FIG. 1*a* wherein the bottom projection 12*f* is removed along dotted line 12*t*. Thereafter, the tie-back is positioned so that its flange portion 14*b* is arranged above the cooperating coaligned recesses 12*i*, 12*h* arranged in adjacent, side-by-side face plates as shown, for example, in FIG. 1*c*. The tie-back is then lowered so that its left and right-hand flange portions Fa and Fb enter into the cooperating recesses 12*j*, 12*i*. The shorter projections 12*l*, 12*n* provide adequate clearance for receiving the integral, rearwardly extending central portion 14*a* of tie-back 14 therebetween. The remaining tie-backs 14*b'* and 14*b''* (see FIG. 3) are assembled in a similar fashion.

Figures 2A, 2B, 2C, 2D:
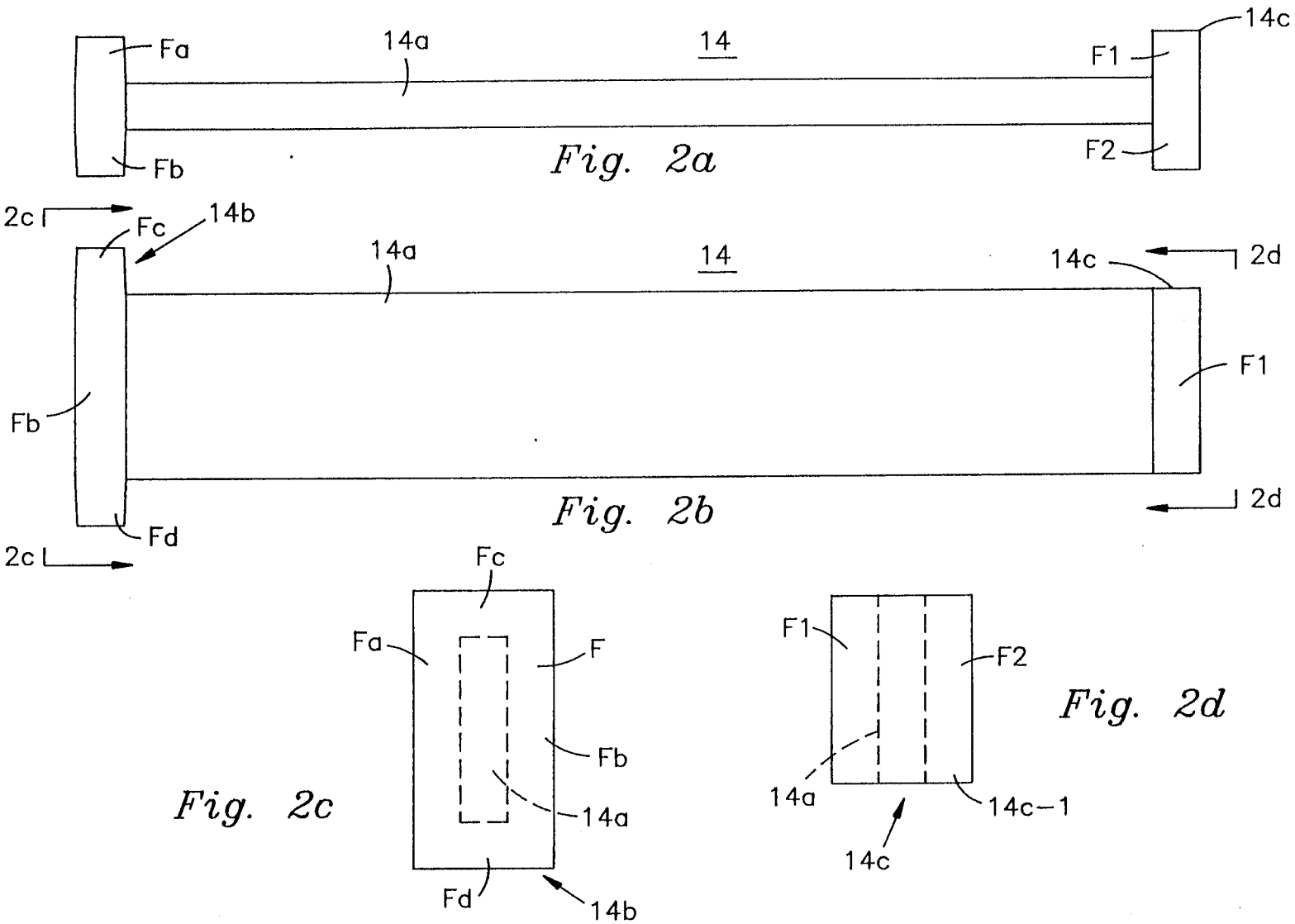
FIGS. 2*a* and 2*b* show top and side views respectively of a tie-back.
FIG. 2*c* shows a front end view of a tie-back looking in the direction of arrows 2*c*, 2*c* of FIG. 2*b;*
FIG. 2*d* shows a rear elevational view of the rear end of the tie-back of FIG. 2*b* looking in the direction of arrows 2*d*, 2*d;*

Thereafter, the region behind the first course of face plates is back filled with earth to a height B1 and a second course of face plates are mounted upon the first course of face plates 12' such that the recess 12*h* in the lower projection 12*f* (see FIG. 1*a*) receives the upper flange portion Fc of tie-back 14 (see FIG. 2*c*). The remaining face plates of the second course are arranged in a similar fashion, each of the face plates preferably being provided with lift openings 12*p*, 12*q*, 12*r* and 12*s* respectively arranged on the left and right-hand sidewalls of upper and lower projections 12*e* and 12*f* as shown best in FIGS. 1*a* and 1*b*. These openings are adapted to receive lift pins (not shown) which may cooperate with eyelets provided on suitable lifting cables (not shown for purposes of simplicity). The face plates are preferably provided with upper and lower pairs of lift pin openings 12*p*, 12*q* and 12*r*, 12*s* due to the fact that the face plates are symmetrical about both a horizontal and vertical centerline and thus may be lifted and arranged in place with the projections 12*e* and 12*f*, as well as the projections 12*c* and 12*d*, being either as shown in FIG. 1*a* or reversed, the symmetry of the face plates thus simplifying fabrication, handling and assembly thereof. Other lift devices may be provided as appropriate to remove sections from molds and for handling during storage, loading and erection.

After proper positioning of the second course of face plates, the region behind the retaining wall assembly being constructed is back filled in one foot layers, for example, as shown by dotted line B1, B2, B3 in FIG. 3. Thereafter, the tie-backs employed in the second course are lifted, aligned and then lowered into place in a manner similar to that described in connection with the tie backs employed to engage the first course of face plates. The tie-back 14, for example, employed in the second course of face plates is aligned so that its left and right-hand flange portions Fa and Fb slide into the vertically aligned recesses, such as, for example, the recesses 12*j* and 12*i* shown in FIG. 1*c*, and ultimately so that the lower flange Fd enters into the recess 12*g* of upper projection 12*e* (note FIGS. 1*a* and 1*b*). The remaining tie-backs are assembled with the cooperating face plates in the second course in a similar fashion.

The bottom surface 14*c*–*l* of the stabilizing back feet or flanges of the tie-backs rest upon the compacted earth and add further stability to the retaining wall assembly by preventing the tie-backs, as well as the face plates, from twisting. The length of the tie-backs further serve to add stability to the retaining wall assembly and the overall length varies according to wall height, the longer tie-backs being utilized at the bottom of the retaining wall assembly with the shorter tie-backs being used at increasing heights of the retaining wall assembly.

As can clearly be seen from the foregoing description, the construction of the retaining wall assembly 10 is quite simple and straightforward and does not require any FIGS. 5*a*–5*f* show a modified face plate 20 having a substantially flat front face 20*a* and, similar to face plate 12, is provided with upper, lower, left and right-hand projections 20*b*, 20*c*, 20*d*, and 20*e*, each having rearwardly extending portions 20b–l, 20c–l, 20d–l and 20e–l respectively. Each of these rearwardly extending projections cooperate with their associated projections 20b–20e to define recesses 20f, 20g, 20h and 20i, respectively. These recesses cooperate with associated interlocking flange portions of the tie-back flange 14b shown, for example, in FIGS. 2a–2d. In all other respects, the face plate 20 of FIGS. 5a–5f functions in the same manner as the face plate 12 shown, for example, in FIG. 1a and the erection of a retaining wall assembly employing face plate 20 is substantially the same as that described hereinabove when erecting a retaining wall assembly employing the face plate 12, it being further understood that the modified face plate utilized in the first course of the retaining wall structure may be formed by omitting the lower projection 20d shown, for example, in FIG. 5a.

Figure 5E:
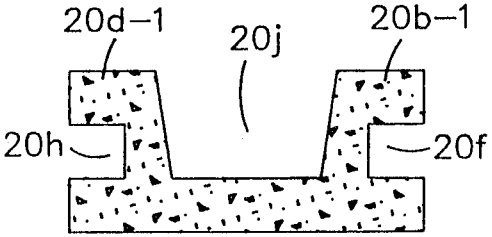
FIG. 5*e* is a sectional view of the face block shown in FIG. 5*a* looking in the direction of arrows A—A.
Figure 5F:
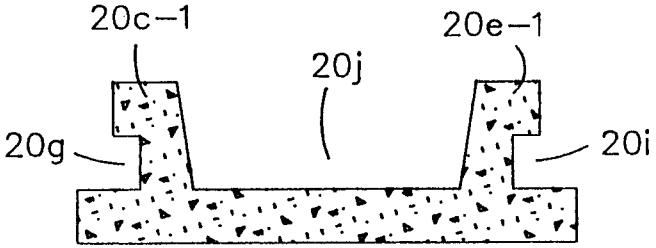
FIG. 5*f* shows a sectional view of the face block of FIG. 5*a* looking in the direction of arrows B—B.
Figure 5B:
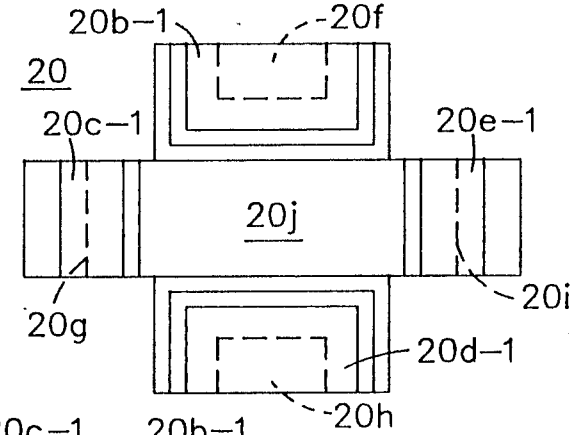
FIGS. 5*b*, 5*c* and 5*d* respectively show rear elevation, top and end views of the face block of FIG. 5*a;*
Figure 5C:
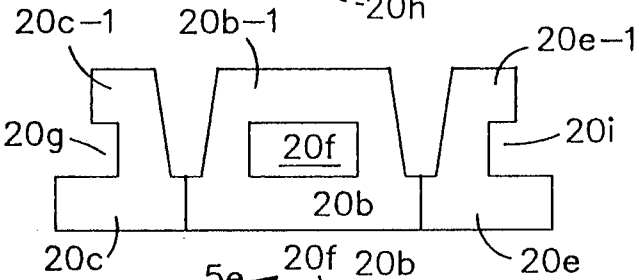

Additional functional characteristics of the face plate 20 reside in the fact that the face plate can be reduced in weight as compared with the face plate 12 shown in FIG. 1a, due to the fact that the rearward projections 20b–l through 20e–l define a centrally located cavity 20j as shown best in FIGS. 5b, 5e and 5f. The cavity 20j provides the dual function of adding to the stability of each face plate due to the fact that each cavity 20j is filled with earth as each back fill layer is formed. A retaining wall assembly formed of face plates 20 thus retains all of the advantageous characteristics of the retaining wall assembly utilizing face plates 12 while contributing the additional advantages described hereinabove.

Although not shown, for purposes of simplicity, the face plate 20 may be provided with lifting pin openings, lift rings or other suitable means to facilitate lifting, handling and transportation of the face plates. It should further be noted that the face plates 20 further retains the horizontal and vertical symmetry features of face plate 12 enabling face plate 20 to be mounted within a retaining wall assembly with the upper projection 20b, for example, extending either upwardly or downwardly.

FIGS. 6a through 8 show another alternative retaining wall assembly 25 comprised of a plurality of face plates 30 and tie-backs 40. Face plate 30 is shown in detail in FIGS. 6a–6c and comprises a substantially rectangular-shaped parallelepiped having a rectangular-shaped front and rear face 30a, 30b. The edges of the front face are preferably chamfered as shown at 30a-1, 30a-2, 30a-3 and 30a-4. Face plate 30 has substantially flat top, bottom and left and right-and sides 30b, 30c, 30d and 30e. The upper and lower surfaces 30b and 30d are each provided with substantially T-shaped recesses 30b-1, 30b-2, and 30d-1, 30d-2, respectively. These recesses cooperate with tie-backs 40 each having a straight, elongated central portion 40a provided with an interlocking flange portion 40b and with a stabilizing flange portion 40c, respectively arranged at the forward and rearward ends of the tie-backs (see FIGS. 7a–7e).

Figure 7B:
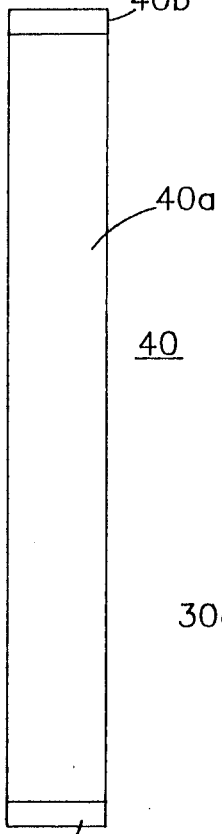
FIGS. 7*a* and 7*b* show top plan and side elevational views respectively of a tie-back designed for use with the face plate shown in FIGS. 6*a*–6*c;*
Figure 7A:
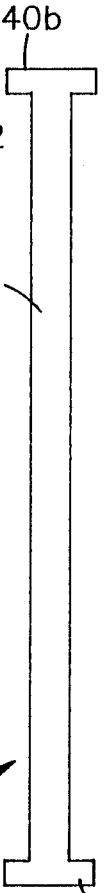
Figure 7C:
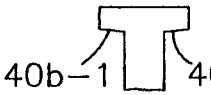
FIG. 7*c* shows an enlarged detail of one end of a tie-back as shown in FIG. 7*a;*

The interlocking T-shaped recesses 30b-1 and 30b-2 have a height substantially equal to half the height H of tie-back 40 (see FIG. 7b).

Figure 5A:
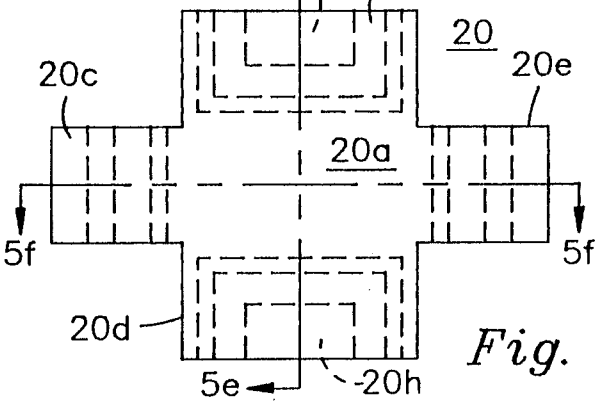
FIG. 5*a* shows a front elevational view of the front face of a face block which is a modification of the face block shown in FIGS. 1*a*–1*c;*
Figure 5D:
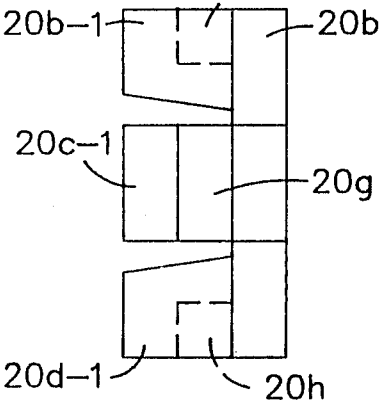
Figure 8:
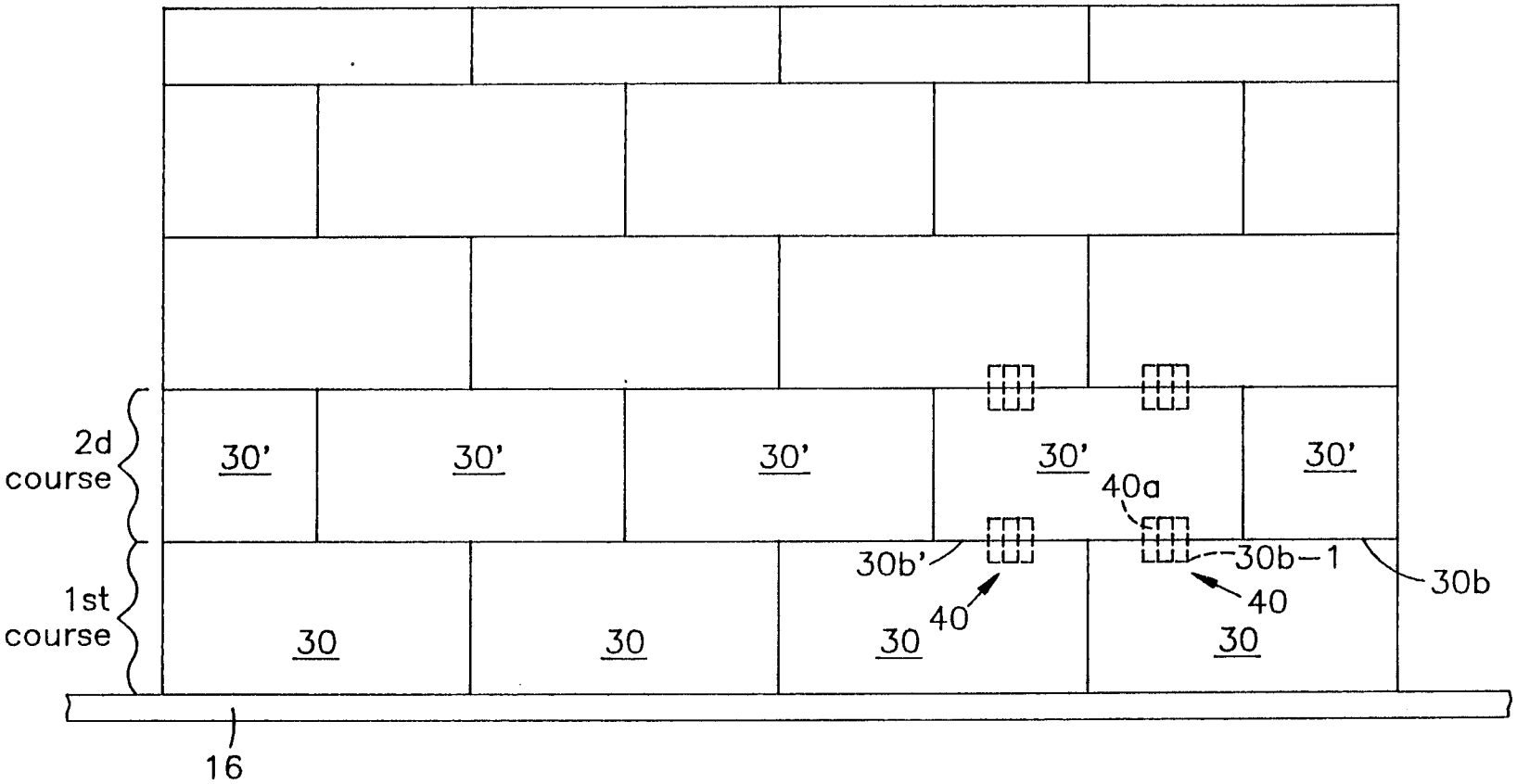
FIG. 8 shows a retaining wall assembly embodying the face plates and tie-backs of FIGS. 6*a*–6*c* and 7*a*–7*c;*

The manner in which a retaining wall comprised of face plates 30 and tie-backs 40 is erected is substantially similar to that described hereinabove in connection with the embodiments of FIGS. 1a and 5a, for example, in that a levelling pad is placed at the desired location and suitably levelled whereupon the first course of face plates 30 are placed upon levelling pad 16 as shown in FIG. 8. The region behind the first course of face plates 30 is back filled and tie-backs 40 are each moved into place so that their interlocking flange portions 40b are each slidably positioned within an associated T-shaped recess such as, for example, the T-shaped recess 30b-1 provided in face plate 30 shown arranged in the first course of the retaining wall assembly of FIG. 8. Each tie-back rests upon a layer of earth provided as back fill behind the first course of face plates. The feet 40c-1 and 40c-2 of the stabilizing flange 40c extend in opposing directions and serve to stabilize the tie-back, as well as the associated face plates interlocked with the tie-back giving common support to the wall while contributing to its integrity and alignment.

Due to the geometry of the T-shaped recesses, such as recess 30b-1 and the tie-back flanges 40b, approximately one-half of the tie-back 40 shown in FIG. 8 extends above the upper edge 30b of face plate 30.

The second course of face plates is put into place in such a manner that the T-shaped recesses along the side 30d' of face plate 30' interlocks with the upper halves of the interlocking flanges 40a, 40a'.

The remaining face plates of the second course are aligned with the components of the lower course and lowered into position in a similar fashion, whereupon a second back fill layer is formed upon the last back fill layer and the tie-backs for the next course are positioned in place in a similar fashion. The remaining courses are constructed in a similar manner with the exception that the tie-back utilized in the upper courses are typically a shorter length.

The retaining wall assembly shown in FIG. 8 exhibits substantially all of the novel and advantageous characteristics of the retaining wall assemblies previously described, with each face plate being interlocked with four adjacent face plates by way of the tie-backs, with the exception of the first course of face plates. If desired, the first course of face plates may receive tie-backs inserted into the T-shaped grooves along their lower sides. If desired, tie-backs of half the height of the tie-backs shown in FIGS. 7a and 7b may be employed for engaging with the T-shaped locking grooves along the lower sides of the face plates 30 employed in the first course of the retaining wall assembly, although the tie-backs are normally required at this level.

Figure 6D:
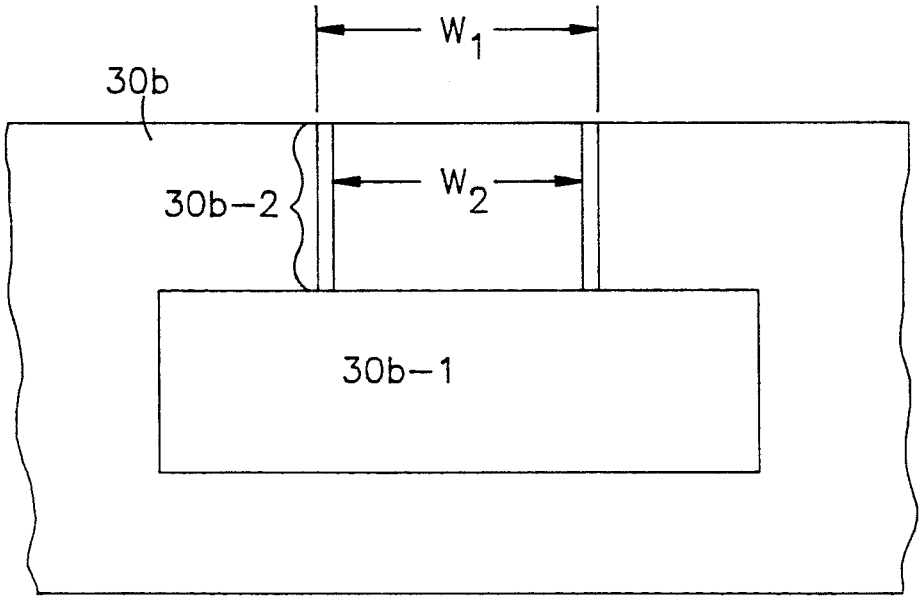
FIGS. 6*d* and 6*e* are elevational views of alternative arrangements for the tie-back flanges.
Figure 6E:
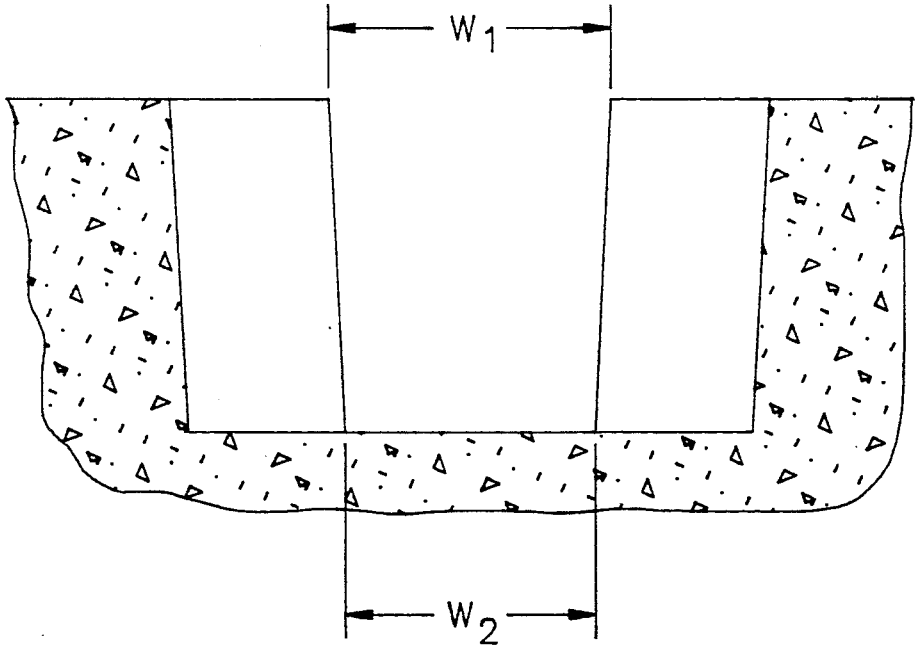
Figure 6B:
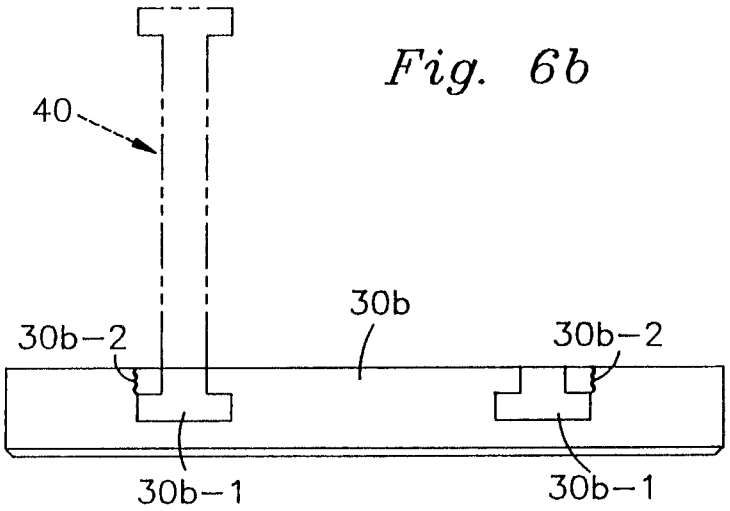
FIGS. 6*b* and 6*c* respectively show top and left-hand side views of the face block of FIG. 6*a;*
Figure 6A:
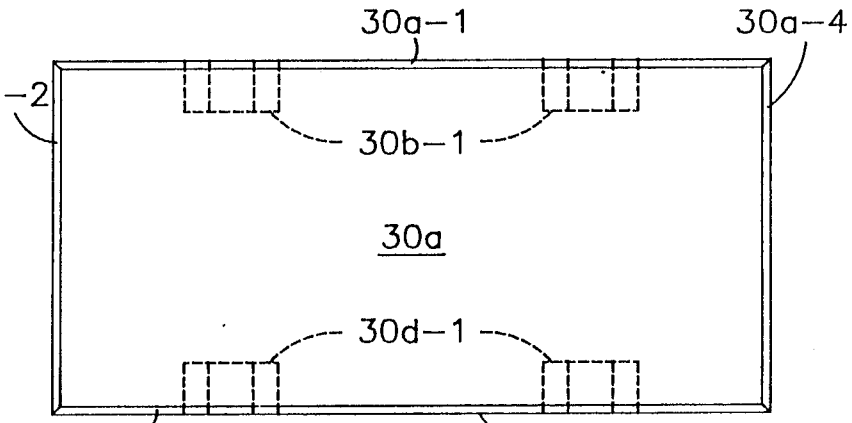
FIG. 6*a* shows a front elevational view of another face block embodiment of the present invention.
Figure 6C:
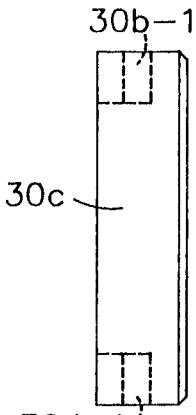
Figure 7D:
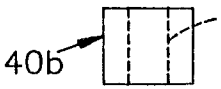
FIGS. 7*d* and 7*e* show alternative arrangements for the interlocking flange of the tie-back of FIGS. 7*a* and 7*b;*
Figure 7E:
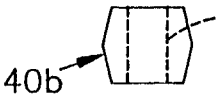

The T-shaped grooves provided along the top and bottom sides of each face plate 30 are preferably tapered to facilitate insertion of the interlocking flanges of a tie-back. For example, FIGS. 6d and 6e show a detailed view of one typical T-shaped groove 30b-1 provided along the upper side 30b. The width of the portion 30b-2 of groove 30b-1 tapers from a larger width W1 at the entry into the groove to a narrower width W2 at the base of the groove. The flange 40b may have straight sides as shown in FIG. 7d or may have tapering sides as shown by the interlocking flange 40b' of FIG. 7e. The flange may also be tapered along the inside surfaces 40b-1, 40b-2 so that the width is slightly greater at the base of each flange than at the free end. For example, the free ends may have a thickness of the order of 2.25 inches and be of the order of 2.5 inches at the base thereof. The taper within the T-shaped slots may be of the order of 4.0 inches at the base W2 and 4.5 inches at the entrance W1 of the slot portion 30b-2. The tie-backs are preferably formed of concrete and weigh on the order of 100 pounds per foot. The embodiment of FIG. 5a, for example, weighs on the order of 1000 pounds when of a size whose front face is of the order of ten square feet.

Figure 11A:
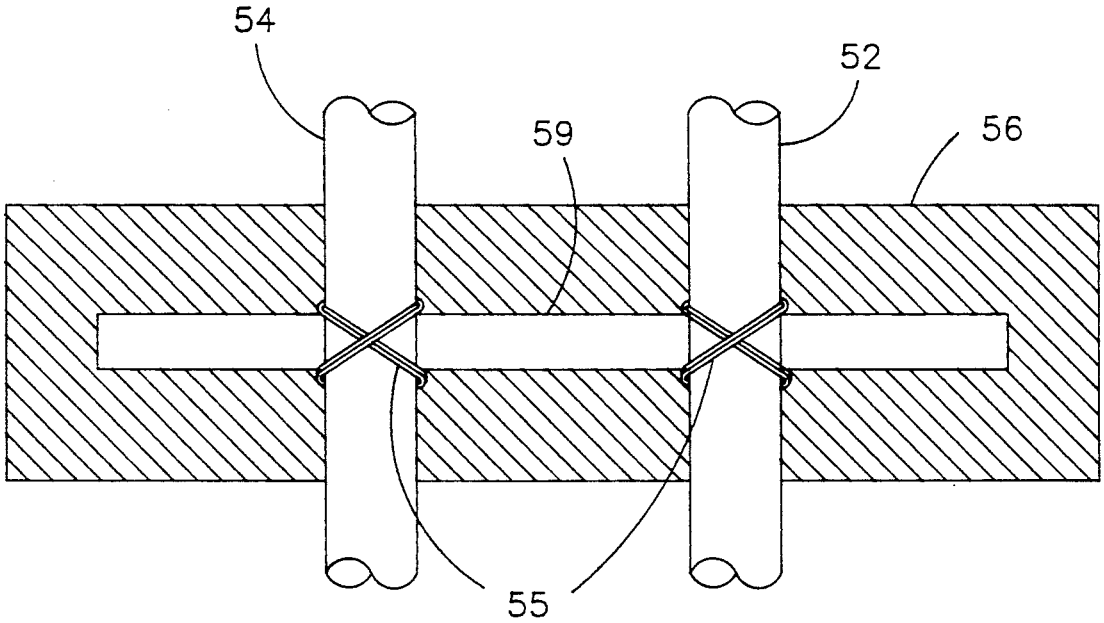
FIG. 11*a* is a detailed sectional view of the anchor member of FIG. 11.

FIGS. 9a–11a show another preferred embodiment of a tie-back 50 embodying the principles of the present invention and being comprised of a pair of elongated metallic rods 52 and 54 provided with a plurality of cast (preferably concrete) anchors 56 arranged at spaced intervals along bars 52 and 54, as shown best in FIGS. 9a and 9b. FIG. 11 shows a typical anchor 56 having parallel top and bottom surfaces 56a and 56b and having a wide central portion of a width W which tapers upwardly and downwardly from a central portion to form vertices with the top and bottom surfaces 56a and 56b each of the same width which is less than the width of the anchor at the central portion thereof. The ends of the anchor 56 taper in a similar fashion to define diagonally aligned upper end surfaces 56c, 56d and diagonally aligned lower end surfaces 56e and 56f. These surfaces are respectively joined with the diagonally aligned longitudinal upper surfaces 56g and 56h and diagonally aligned lower longitudinal surfaces 56i and 56j. The anchors 56, in addition to retaining rebars 52 and 54 in spaced parallel fashion, further serve as stabilizing means for stabilizing the tie-back within the backfill, preventing the tie-back from twisting or turning.

Anchors 56 are preferably spaced at predetermined intervals, preferably of the order of three feet from centerline to centerline. The length of a tie-back varies in accordance with the relative height position of the tie-back within a retainer wall assembly as shown, for example, in FIG. 4. The tie-backs of FIGS. 9a and 9b are capable of utilizing the same formula for determining tie-back length as was described hereinabove for the tie-backs of FIG. 4, for example.

The forward end of tie-back 50 is provided with a cast (preferably concrete) key block for interlocking with face plates such as, for example, the face plates of FIGS. 1a through 1c, the forward end of key block 58 being similar in shape to the flange 14b shown, for example, in FIGS. 2a–2d and being comprised of a flange portion F and an integral rearwardly projecting portion G similar in shape to the central portion 14a of tie-back 14 shown in FIGS. 2a–2d. The forward ends of rods 52 and 54 are respectively bent upwardly and downwardly forming end portions 52a, 54a, a reinforcing cross-bar 53 being secured to rods 52, 54 at their bending corners. Bar 53 and ends 52a, 54a are embedded in key block 58 and serve to absorb the forces imparted to key block 58 by rods 52 and 54. Bar 53 is secured to rebars 52, 54 preferably by wire ties to prevent the corrosion resistant surface of the rebars 52, 54 from being degraded.

FIG. 11a is a sectional view of one typical anchor 56. A reinforcing cross-bar is wire tied to rebars 52, 54 by tie-wires 55, 55 as shown. The rebars (as well as the cross-bars) are galvanized, anodized, epoxy coated or otherwise treated to provide corrosion resistance. The tie-wires 55 prevent the corrosion resistant treatment from being degraded as would welding or other mechanical fastening techniques. The reinforcing rods employed in the key block F are joined to the rebars in a similar manner. Molds are placed around the rebars and the molds are filled with casting material (i.e. concrete). The molds are removed after the cast material is set. The molding technique is conventional and details thereof have been omitted for purposes of brevity.

The flange portions of the substantially rectangular-shaped flange F shown in FIGS. 9a and 9b interfit within the slots provided within the face plate members to provide an interlocking relationship substantially the same as that shown in previous embodiments such as, for example, the embodiment shown in FIGS. 1d and 1c. More specifically, noting FIG. 10, two side-by-side face plate members 12 and 12' viewed from above, in the same fashion as the embodiment shown in FIG. 1c, receive the oppositely-directed left and right-hand flange portions $F_a$ and $F_b$ in much the same fashion as the flange portion of a tie-back 14 is received within the slots of face plates 12 and 12'. The top and bottom flange portions of the key block 58 are similar to the top and bottom flange portions $F_c$ and $F_d$ shown in FIG. 2c and similarly interlock with appropriate slots within the adjacent face plate in the manner shown, for example, in FIG. 1b. Thus, the tie-back 50 is provided with cast key block flange portions which interlock with the face plates in a manner substantially the same as that shown in previous embodiments thus retaining the novel interlocking arrangement between face plates and tie-backs, which interlocking components are preferably formed of the same non-corrosive cast material, while retaining the two-piece modular building block arrangement, preserving the features of previous embodiments which reduce the size and weight of the building block element, and which further simplify handling and storage of these modular elements while at the same time providing increased resistance to breakage caused by vibration and impacts due, for example, to vehicular traffic.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

In addition, since the interlocking and hence interengaging components are formed of the same material, they have the same expansion and contraction characteristics ensuring excellent interlocking.

What is claimed is:

1. A retaining wall assembly comprising:

a wall face comprised of a plurality of engaging face plates;

each face plate having a cross-shaped front face including projections extending from and surrounding a centered face said projections facing in upward, downward, leftward and rightward directions when the face plate is vertically oriented in said wall assembly;

all of said projections having interlocking sides provided with locking recesses displaced rearwardly from the front face;

a plurality of tie-backs each having an elongated body portion and an integral interlocking flange arranged at one end of said body portion;

said interlocking flange being received in selected recesses of at least three adjacent, engaging face plates including the interlocking recesses in adjacent left and right side projections;

said tie-backs being aligned with their elongated body portions arranged substantially perpendicular to said face plates and being of a length adapted to enhance the stability of the retaining wall assembly.

2. The retaining wall assembly of claim 1 wherein said face plates and tie-back/anchors are formed of the same casting material.

3. The retaining wall assembly of claim 2 wherein said casting material is a suitable concrete.

4. The retaining wall assembly of claim 1 wherein said tie-back interlocking flange has a height which is at least equal to the height of the elongated body portion and wherein said flange extends a predetermined distance away from the opposite sides of said elongated body portion to define a T-shaped configuration with said body member.

5. The retaining wall assembly of claim 1 wherein each tie-back is provided with an integral stabilizing and anchoring flange at the end of said tie-back opposite said interlocking flange.

6. The retaining wall assembly of claim 5 wherein said stabilizing flange comprises a pair of flange portions extending in opposite directions and arranged on opposing sides of said elongated body portion and being adapted to rest upon a back fill layer provided behind the retaining wall assembly, said stabilizing and anchoring flange of the retaining wall assembly enhances the wall stability by restraining horizontal forces from the soil and thus preventing the wall from overturning or sliding.

7. The retaining wall assembly of claim 1 wherein the rearward surface of each face plate is provided with a central cavity to provide a reduced thickness portion of the face plate in the central region thereof.

8. The retaining wall assembly of claim 7 wherein the region behind the retaining wall assembly is back filled with earth which is placed against the rear surfaces of said face plates and into the central cavities in the rearward surface of each face plate to enhance the structural strength of the retaining wall assembly.

9. A retaining wall assembly comprising:

said retaining wall assembly having a wall face comprised of a plurality of engaging face plates;

each face plate having upper, lower, left and right-hand sides surrounding a front face;

at least two of said sides being provided with locking recesses displaced rearwardly from the front face;

a plurality of tie-backs each having an elongated body portion and an integral interlocking flange arranged at one end of said body portion;

said interlocking flange being received in the recesses of at least first and second adjacent, engaging face plates;

said tie-backs being aligned with their elongated body portions arranged substantially perpendicular to said face plates and being of a length adapted to enhance the stability of the retaining wall assembly;

each of said face plates have a substantially cross-shaped configuration defined by a central portion and integral upper, lower and left and right-hand portions projecting outwardly from said central portion;

said face plates being adapted to interengage on another in a retaining wall assembly having a plurality of courses such that the side and upward projections of adjacent face plates cooperate to define a rectangular-shaped region for receiving the downwardly directed projection of a face plate arranged thereon thereby providing a continuous retaining wall of neatly interlocked face plates, the recesses of adjacent side projections receiving the interlocking flange of a common tie-back.

10. A retaining wall assembly comprising:

said retaining wall assembly having a wall face comprised of a plurality of engaging face plates;

each face plate having upper, lower, left and right-hand sides;

at least two of said sides being provided with locking recesses;

a plurality of tie-backs each having an elongated body portion and an integral interlocking flange arranged at one end of said body portion;

said interlocking flange being received in the recesses of at least first and second adjacent, engaging face plates;

said tie-backs being aligned with their elongated body portions arranged substantially perpendicular to said face plates and being of a length adapted to enhance the stability of the retaining wall assembly;

each of said face plates having a substantially cross-shaped configuration defined by a central portion and integral upper, lower and left and right-hand portions projecting outwardly from said central portion;

said face plates being adapted to interengage one another in a retaining wall assembly having a plurality of courses such that the side and upward projections of adjacent face plates cooperate to define a rectangular-shaped region for receiving the downwardly directed projection of a face plate arranged thereon thereby providing a continuous retaining wall of neatly interlocked face plates;

each of said projections being provided with an interlocking flange receiving recess;

the portions of the left and right-hand side projections extending between said recess and the back surface of the face plate being shorter than the sides of the left and right-hand projecting portions extending between the recess and the front surface of the face plate to provide clearance for the receipt of the elongated body portion of a tie-back whereby the interlocking flange of a tie-back engages the recesses of four adjacent, engaging face plates.

11. The retaining wall assembly of claim 10 wherein the interlocking flange of each of said tie-backs comprises flange portions which extend a predetermined distance above, below, to the left, and to the right of said elongated body portion which is integrally joined to the center of said interlocking flange, whereby each of said flange portions is received in a recess of the four adjacent, engaging face plates.

12. A retaining wall assembly comprising:

said retaining wall assembly having a wall face comprised of a plurality of engaging face plates;

each face plate having upper, lower, left and right-hand sides;

at least two of said sides being provided with locking recesses;

a plurality of tie-backs each having an elongated body portion and an integral interlocking flange arranged at one end of said body portion;

said interlocking flange being received in the recesses of at least first and second adjacent, engaging face plates;

said tie-backs being aligned with their elongated body portions arranged substantially perpendicular to said face plates and being of a length adapted to enhance the stability of the retaining wall assembly;

each face plate having a substantially cross-shaped configuration defined by a central portion and upwardly, downwardly, leftwardly and rightwardly extending integral projections, each having a recess provided along the side surfaces thereof;

the recesses in each projecting portion extending substantially the entire length of each projecting portion and being defined by spaced projections, one of said projections lying between the rear surface of the face plate and the recess and the other projecting portion lying between the front surface of said face plate and said recess;

the projecting portion lying between the rear surface of said face plate and said recess on two opposing sides of said face plate being shorter than the cooperating projecting portion extending between the front surface of the face plate and the associated recess to collectively receive the elongated portion of a tie-back.

13. A method for erecting a retaining wall assembly, said retaining wall assembly having a wall face comprised of a plurality of engaging face plates;

each face plate having a substantially cross-shaped configuration defined by a central portion and integral upper, lower and left and right-hand portions projecting outwardly from said central portion;

said face plates being adapted to interengage one another in a retaining wall assembly having a plurality of courses such that the side and upward projections of adjacent face plates cooperate to define a rectangular-shaped region for receiving the downwardly directed projection of a face plate arranged thereon thereby providing a continuous retaining wall of neatly interlocked face plates, the recesses of adjacent side projections receiving the interlocking flange of a common tie-back;

each of said projecting portion having interlocking sides being provided with locking recesses;

a plurality of tie-backs each having an elongated body portion and an integral interlocking flange arranged at one end of said body portion;

said interlocking flange being received in the recesses of at least three adjacent, engaging face plates;

said tie-backs being of a length adapted to enhance the stability of the retaining wall assembly;

said method comprising the steps of:

(a) providing a level surface upon which the face plates of the retaining wall assembly are to be erected;

(b) erecting a first course of face plates by arranging the face plates so that their front faces are transverse to the horizontal plane, the face plates being lifted sequentially and lowered into position upon the leveled surface with the sides of adjacent face plates being in engagement;

(c) back filling the region behind the first course of face plates with earth;

(d) sequentially positioning each of a plurality of tie-backs above the first course of face plates with the tie-back interlocking flange arranged above a recess provided in an upper projection in an associated one of the face plates in said first course;

(e) lowering each tie-back so that its interlocking flange enters into the recess with which it is aligned in step (d) and so that at least the rear end of each tie-back rests upon the last-mentioned back fill layer;

(f) forming a second course of face plates with each of said face plates in the second course arranged in side-by-side fashion by sequentially positioning each face plate above a pair of associated tie-backs so that the recesses of its left and right-hand portions are aligned with the last-mentioned associated tie-back interlocking flanges and lowering the face plate so that the flanges o said last-mentioned tie-backs with which it is aligned enter into the recesses of the left and right-hand portions aligned therewith;

(g) forming an additional back fill layer upon the previous back fill layer; and (h) completing the third and additional courses of the retaining wall assembly by repeating the steps (b) through (g).

14. A retaining wall assembly comprising:

said retaining wall assembly having a wall face comprised of a plurality of engaging face plates;

each face plate having upper, lower, left and right-hand sides surrounding a front face;

at least two of said sides being provided with locking recesses displaced rearwardly from the front face;

a plurality of tie-backs each having an elongated body portion and an integral interlocking flange arranged at one end of said body portion;

said interlocking flange being received in the recesses of at least first and second adjacent, engaging face plates;

said tie-backs being aligned with their elongated body portions arranged substantially perpendicular to said face plates and being of a length adapted to enhance the stability of the retaining wall assembly;

said tie-back means comprising:

a plurality of elongated rods arranged in substantially spaced, parallel fashion;

the first ends of the rods being embedded in a block of cast material; and a plurality of cast anchor members being arranged at spaced intervals along said plurality of rods, said rods being embedded in said anchor members.

15. A retaining wall assembly according to claim 14 wherein said anchor members and key block are formed of the same cast material.

16. A retaining wall assembly according to claim 15 wherein said cast material is concrete.

17. A retaining wall assembly according to claim 14 wherein said anchor members have a longitudinal length which is transverse to the longitudinal axes of said rods and wherein the longitudinal length of said anchor members is substantially greater than the distance between said rods.

18. A retaining wall assembly according to claim 14 wherein said rods are galvanized rebars.

19. A retaining wall assembly according to claim 14 wherein said key block has a free end provided with flange portions for insertion into the slots in said face panels.

20. A retaining wall assembly according to claim 19 wherein said key block free end has a substantially rectangular shape defining first, second, third and fourth flange portions.

21. A tie-back assembly comprising:

a plurality of elongated metallic rods arranged in spaced, substantially parallel fashion;

a key block formed of a suitable casting material being cast at one end of said rods and enclosing a portion of the forward ends of said rods;

at least one anchor block formed of a suitable casting material being cast at a location spaced from said key block and encasing a portion of each rod, said anchor block having an elongated body extending transverse to the longitudinal axis of said rods and being of a length greater than the separation distance of said rods for stabilizing the tie-back assembly against twisting when arranged in a completed retainer wall assembly.

22. Apparatus according to claim 21 wherein said rods are rebars.

23. Apparatus according to claim 21 wherein said rods are treated with means for resisting corrosion.

24. Apparatus according to claim 21 further comprising a plurality of reinforcing rods arranged transverse to said elongated rods and respectively embedded in said key block and said anchor for structural reinforcement.

25. Apparatus according to claim 24 wherein said elongated rods and said reinforcing rods are treated with means for resisting corrosion.

26. Apparatus according to claim 25 including means for joining said reinforcing rods to said elongated rods without degrading the corrosion resistant means.

27. Apparatus according to claim 26 wherein said joining means comprises wire-ties for tying said reinforcing rods and said elongated rods to one another.

28. A tie-back assembly according to claim 21 comprising a plurality of anchors arranged at spaced intervals along said elongated rods.

29. A tie-back assembly according to claim 28 wherein said anchors are spaced apart a distance of the order of three feet.

30. A tie-back assembly according to claim 21 wherein said key block includes integral flanges for interlocking with grooves provided in said face plates.

31. A tie-back assembly for interlocking use with face plates of a retainer wall system comprising:

a key block formed of a substantially rigid material having flanges for interlocking with grooves provided in said face plates;

at least one substantially rigid anchor block for preventing twisting of said tie-back assembly and said face plates when installed in a retainer wall system for stabilizing said system; and elongated substantially yieldable joining means extending between and joined to said anchor block and said key block for significantly reducing the weight of the tie-back and which is formed of a material different from said key block and said anchor block and for preventing the tie-back assembly from breakage in handling and use while substantially preventing the tie-back assembly key block and anchor block from twisting relative to one another.

32. The assembly of claim 31 wherein said key block and anchor block are formed of the same material.

33. The assembly of claim 32 wherein said material is cast material and said elongated means is formed of metal.

* * * * *

UNITED STATES PATENT AND TRADEMARK OFFICE

CERTIFICATE OF CORRECTION

PATENT NO. : 5,127,770

DATED : July 7, 1992

INVENTOR(S) : Ditcher et al.

It is certified that error appears in the above-identified patent and that said Letters Patent is hereby corrected as shown below:

Column 5, after line 9 and before line 10, insert
--right-hand extending projections 12c and 12d and--

Column 6, line 64, after "any" insert
--additional fastening means.--

Column 7, line 50, change "right-and" to --right-hand--

Column 14, line 3, change "o" to --of--

Signed and Sealed this

Twenty-first Day of September, 1993

Bruce Lehman

*Attest:*

BRUCE LEHMAN

*Attesting Officer*

*Commissioner of Patents and Trademarks*